US006983711B1

(12) United States Patent
Lemke

(10) Patent No.: US 6,983,711 B1
(45) Date of Patent: Jan. 10, 2006

(54) PERSONAL WATER CRAFT FENDER

(76) Inventor: Stuart H. Lemke, W1469 Longbasco La., Gleason, WI (US) 54435

( * ) Notice: Subject to any disclaimer, the term of this patent is extended or adjusted under 35 U.S.C. 154(b) by 12 days.

(21) Appl. No.: 11/030,556

(22) Filed: Jan. 6, 2005

Related U.S. Application Data

(60) Provisional application No. 60/535,028, filed on Jan. 8, 2004.

(51) Int. Cl.
*B63B 59/02* (2006.01)

(52) U.S. Cl. ..... 114/219

(58) Field of Classification Search ..... 114/219
See application file for complete search history.

(56) References Cited

U.S. PATENT DOCUMENTS

| | | | | |
|---|---|---|---|---|
| 2,905,129 | A * | 9/1959 | Denend et al. | 114/219 |
| 5,560,312 | A * | 10/1996 | McPherson | 114/219 |
| 5,701,837 | A * | 12/1997 | Harvey | 114/219 |
| 6,021,729 | A | 2/2000 | DeRuscio | |
| 6,863,011 | B2 * | 3/2005 | Kinkead | 114/219 |

* cited by examiner

*Primary Examiner*—Jesus D. Sotelo
(74) *Attorney, Agent, or Firm*—Andrus, Sceales, Starke & Sawall, LLP

(57) ABSTRACT

A protective fender for a personal water craft utilizes a V-shaped resilient body that utilizes a pair of hooks to engage the flange on opposite sides of the water craft. An adjustable strap connects the two hooks and allows for positioning of the hooks and tightening of the entire structure so that the body is securely fastened to the water craft.

7 Claims, 3 Drawing Sheets

PERSONAL WATER CRAFT FENDER

CROSS-REFERENCE TO RELATED APPLICATIONS

This application relates to and claims priority from U.S. Provisional Application Ser. No. 60,535,028 filed Jan. 8, 2004.

FIELD OF THE INVENTION

The present invention relates generally to a protective fender for a floating structure and, more particularly, pertains to a fender for use with a personal water craft such as a jet ski.

BACKGROUND OF THE INVENTION

Protective fenders have been developed for personal water craft. An example of such a fender is shown in U.S. Pat. No. 6,021,729. In this patent, the fender body itself includes a hook portion to engage the bond flange on a personal water craft. A flex region of the body allows the fender to conform to either of the front hull or the rear section of the water craft. A suction cup or securing line is attached to an end of the body opposite the hook portion to further attach the fender to the water craft. Fenders such as disclosed in the '729 patent have the disadvantage of not extending below the water level of the craft and they tend to disengage from the craft far too easily.

It is desirable to provide a protective fender which gives the water craft protection above and below the waterline.

SUMMARY OF THE INVENTION

It is an object of the present invention to provide a protective fender for a personal water craft that is easily positioned on the water craft and, once positioned, is securely fastened to the water craft.

In one aspect of the invention, a protective fender is provided for a personal water craft having a hull with a flange on both sides. The protective fender includes a V-shaped resilient body attachable to the water craft. A first attachment structure is disposed on the body and engageable with the flange on one side of the water craft. A second attachment structure is engageable with the flange on the other side of the water craft. An adjustment structure connects the first and second attachment structures. The body includes a pair of diverging legs. One leg of the V-shaped body is longer than the other leg of the V-shaped body. At least one leg of the V-shaped body has a locking device to secure the adjustment structure to the body. The adjustment structure comprises an adjustable strap between the first and second attachment structures. The body includes a horizontally extending fin projecting from a central portion thereof, the fin being provided with a passageway. The fin is engageable with the flange. Each of the legs has a free end provided with a locking tab having a pair of slots formed therethrough. The free end of one of the legs is provided with a valve for admitting fluid into the body. The flexible strap is passed through the passageway of the fin and is woven through the slots of one of the locking tabs. The body is reversibly disposed on the water craft.

In another aspect of the invention, a protective fender is provided for a personal water craft having a hull with a flange on both sides. The fender includes a reversible V-shaped body attached to the water craft. A first hook structure is disposed on the body and engageable with the flange on one side of the water craft. A second hook structure is disposed on the body and engageable with the flange on an opposite side of the water craft. An adjustable strap is engageable with the body and connects the first and second hook structures.

Various other objects, features and advantages of the invention will be made apparent from the following detailed description in the drawings.

BRIEF DESCRIPTION OF THE DRAWINGS

The drawings illustrate the best mode presently contemplated for carrying out the invention.

In the drawings.

DETAILED DESCRIPTION OF THE INVENTION

Figure 1:
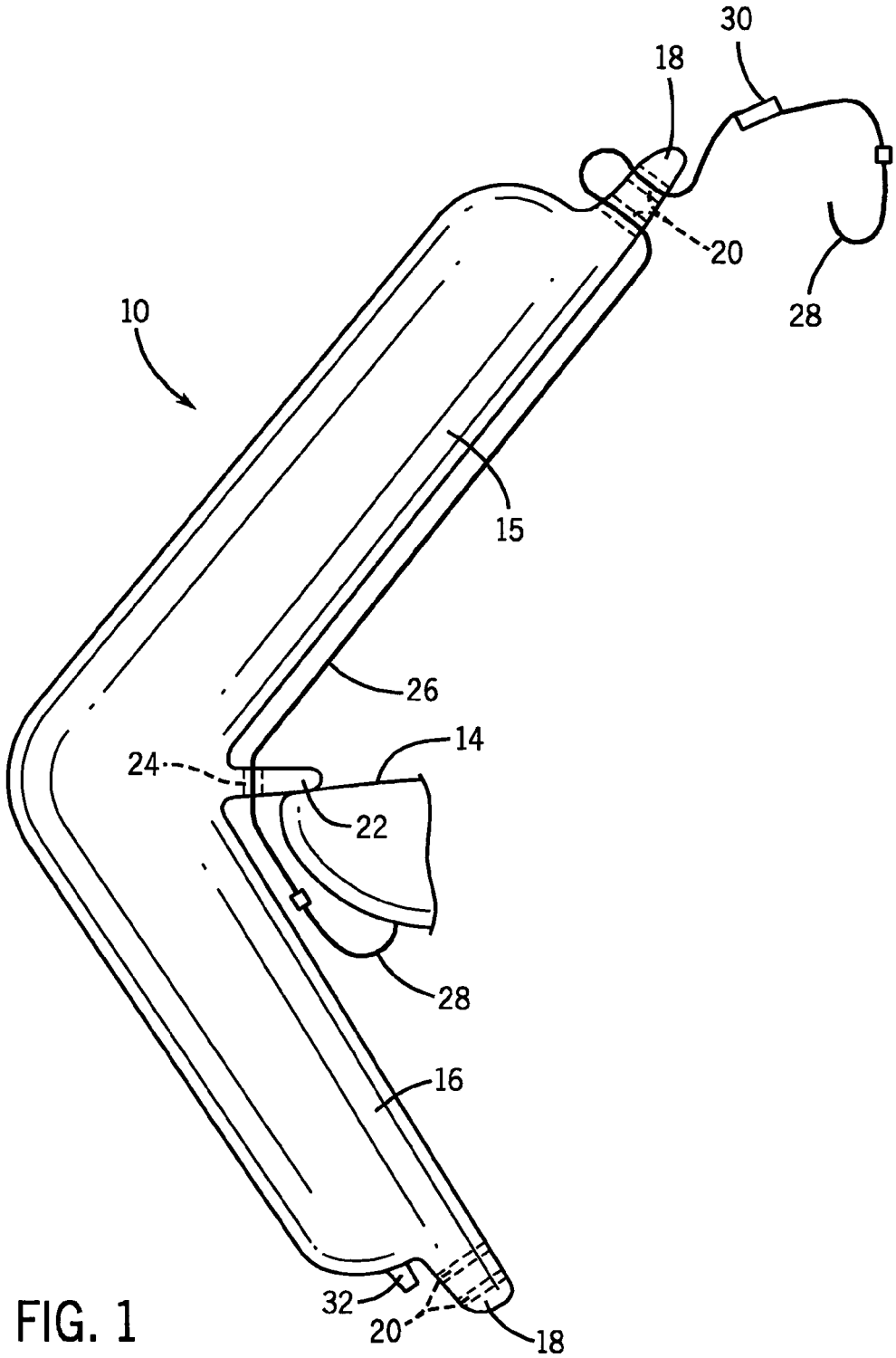
FIG. 1 is a side view of a personal water craft fender constructed according to the present invention.

Referring now to the drawings, thereshown is a resilient, protective fender 10 for use with a personal water craft 12 having a deck 11 and a bond flange 14 extending along the top of a water craft hull 13. The body of fender 10 is formed of a PVC or foam material in a V-shape having a first leg 15 and a second leg 16 with leg 15 being longer than leg 16. Free ends of diverging legs 15 and 16 are each provided with a locking tab 18 having a pair of slots 20 formed therethrough. A horizontally extending fin 22 having a passageway 24 projects from a central portion of the fender 10 where the legs 15 and 16 are joined.

An elongated, flexible strap 26 is passed through passageway 24 in fin 22 and woven through the slots 20 of one of the locking tabs 18 (e.g. the locking tab on leg 15 as shown in FIG. 1). Each end of strap 26 is provided with a J-shaped hook 28. Each of the hooks 28 is engageable with flange 14 and the length of the strap 26 between hooks 28 can be adjusted by means of an adjustment buckle 30.

In use, one of the hooks 28 is engaged with an underside of flange 14 on one side of the water craft with the bottom of fin 22 resting on the top of flange 14 to add stability. The fin 22 can be trimmed if necessary to fit the exact length that the flange 14 extends from the water craft 12. While strap 26 is kept tight, the other of the hooks 28 is secured to flange 14 on the opposite side of the water craft. The strap 26 can now be pulled tight by means of the adjustment buckle 30, thus securing the fender 10 to water craft 12. FIG. 1 illustrates the disposition of a fender 10 wherein the longer leg 15 is oriented upwardly to protect the deck 11 on the forward portion of the water craft 12.

Figure 2:
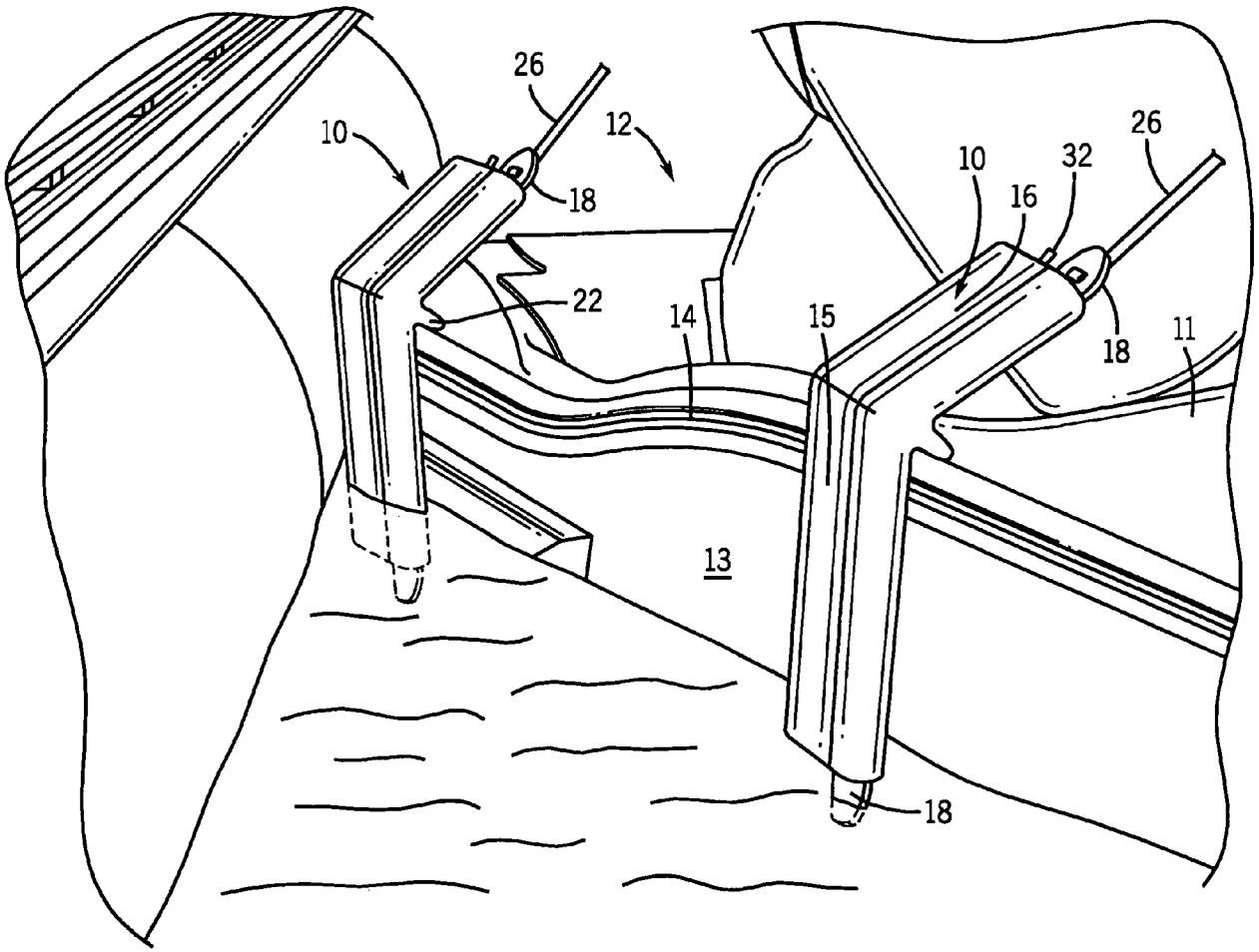
FIG. 2 is a perspective view of one side of a personal water craft equipped with the fender of FIG. 1.
Figure 3:
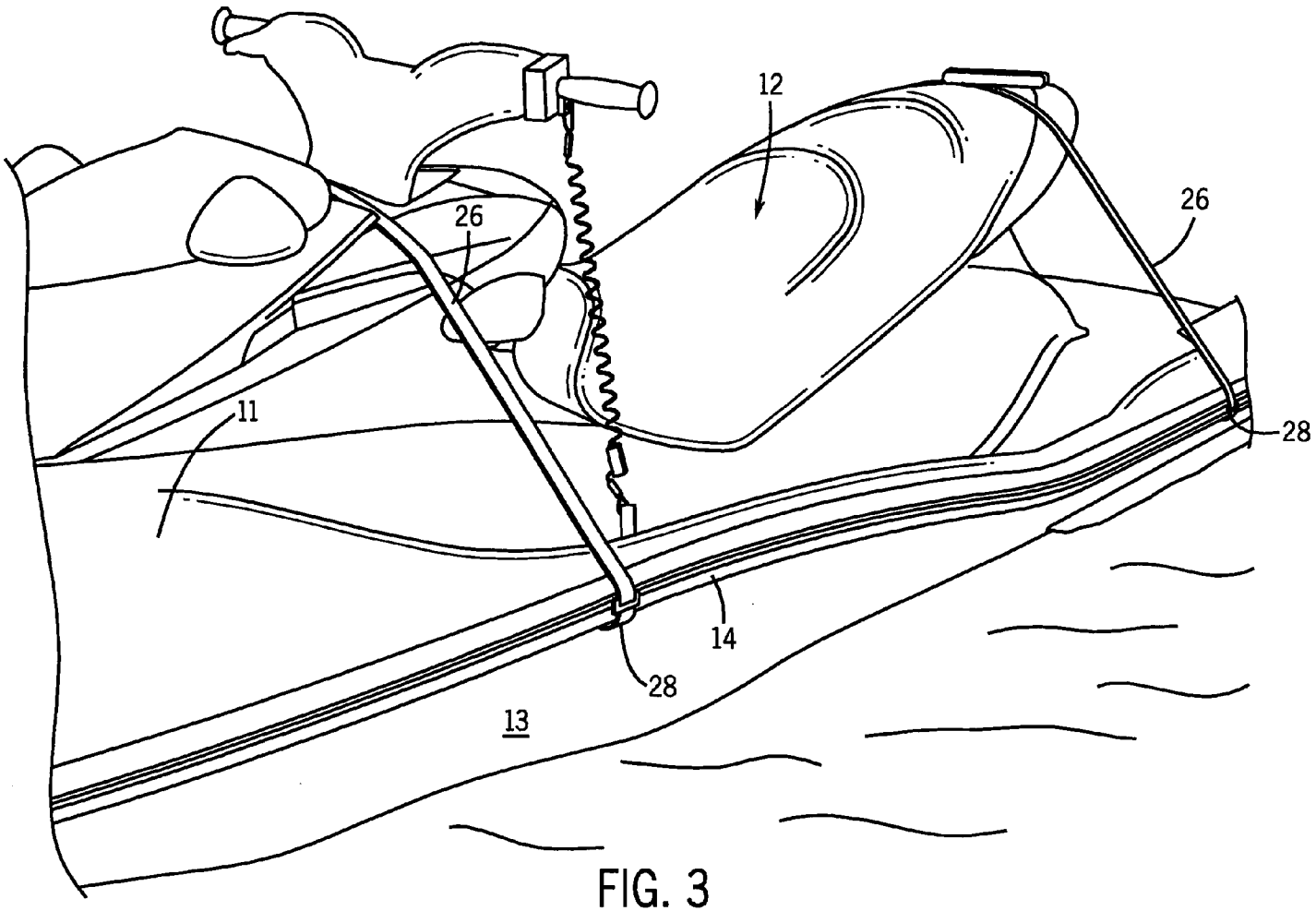
FIG. 3 is a perspective view of an opposite side of the personal water craft equipped with the fender of FIG. 1.

As a feature of the invention, the fender is reversible and can be turned 180 degrees so that the fender 10 can be disposed with the shorter leg 16 oriented upwardly and the longer leg 15 oriented downwardly to give more protection along the hull 13, as shown in FIG. 2. The fender 10 has locking tabs 18 on both free ends so that the fender 10 can be rotated 180 degrees with strap 26 woven through the slots 20 on locking tab 18 of leg 16 and passed through passageway 24 of fin 22. The reversible design of the fender 10 thus gives the water craft protection above and below the water line. Smaller, lightweight personal water craft 12 are subject to extreme rocking and rolling from waves when docked and have previously been subjected to damage above and below the bond flange 14. Accordingly, the fender 10 may be used in either disposition of FIG. 1 or 2 to prevent damage of docked water craft 12 from other boats, piers, rafts and docks. The slots 20 in tabs 18 provide a locking action that prevents the fender from sliding up on the strap and altering the proper location of the installed fender 10.

The free end of leg 16 is provided with a valve 32 for admitting air into an internal chamber in the fender 10 to provide added cushioning and protection. Because storage space for the fender 10 on water craft 12 is limited, the valve 32 may be deflated so that trapped air in the fender 10 may be let out to enable an easier manipulation and storage of the fender 10. In addition, the valve 32 can be used to let a few inches of water into the fender 10 to add stability and prevent it from floating up when it is below the water line.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. A protective fender for a personal water craft having a hull with a flange on both sides comprising:

a V-shaped resilient body attachable to the water craft;

a first attachment means disposed on the body and engageable with the flange on one side of the water craft;

a second attachment means engageable with the flange on the other side of the water craft;

adjustment means connecting the first and second attachment means, wherein the body includes a pair of diverging legs, wherein one leg of the V-shaped body is longer than the other leg of the V-shaped body, wherein at least one leg of the V-shaped body has locking means to secure the adjustment means to the body, wherein the adjustment means comprises an adjustable flexible strap between the first and second attachment means, and wherein the body includes a horizontally extending fin projecting from a central portion thereof, the fin being provided with a passageway.

2. The protective fender of claim 1, wherein the fin is engageable with the flange.

3. The protective fender of claim 2, wherein each of the legs has a free end provided with a locking tab having a pair of slots formed therethrough.

4. The protective fender of claim 3, wherein the free end of one of the legs is provided with a valve for admitting fluid into the body.

5. The protective fender of claim 3, wherein the flexible strap is passed through the passageway of the fin, and is woven through the slots of one of the locking tabs.

6. The protective fender of claim 1, wherein the body is reversibly disposed on the water craft.

7. A protective fender for a personal water craft having a hull with a flange on both sides comprising:

a reversible V-shaped body attached to the water craft;

a first hook structure disposed on the body and engageable with the flange on one side of the water craft;

a second hook structure disposed on the body and engageable with the flange on an opposite side of the water craft; and an adjustable strap engageable with the body connecting the first and second hook structures.

* * * * *